US010487584B2

(12) United States Patent
James

(10) Patent No.: US 10,487,584 B2
(45) Date of Patent: Nov. 26, 2019

(54) DISPLACEMENT ASSEMBLY WITH A DISPLACEMENT MECHANISM DEFINING AN EXHAUST PATH THERETHROUGH

(71) Applicant: SCHLUMBERGER TECHNOLOGY CORPORATION, Sugar Land, TX (US)

(72) Inventor: Jonathan Luke James, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 542 days.

(21) Appl. No.: 15/041,135

(22) Filed: Feb. 11, 2016

(65) Prior Publication Data

US 2016/0237784 A1 Aug. 18, 2016

Related U.S. Application Data

(60) Provisional application No. 62/116,537, filed on Feb. 15, 2015.

(51) Int. Cl.
*E21B 7/06* (2006.01)
*E21B 17/10* (2006.01)
*E21B 21/10* (2006.01)

(52) U.S. Cl.
CPC ..... *E21B 7/06* (2013.01); *E21B 17/1014* (2013.01); *E21B 21/10* (2013.01)

(58) Field of Classification Search
CPC ..... E21B 17/1014; E21B 21/10; E21B 7/06
See application file for complete search history.

(56) References Cited

U.S. PATENT DOCUMENTS 5,520,255 A * 5/1996 Barr ..... E21B 4/003 175/24
5,553,678 A * 9/1996 Barr ..... E21B 4/02 175/324

(Continued)

FOREIGN PATENT DOCUMENTS

EP 0530045 A1 3/1993
WO 2013186554 A2 12/2013

OTHER PUBLICATIONS

International Search Report and Written Opinion issued in related PCT application PCT/US2016/017638 dated May 11, 2016, 15 pages.

(Continued)

*Primary Examiner* — Robert E Fuller
*Assistant Examiner* — Christopher J Sebesta

(57) ABSTRACT

Aspects of the disclosure can relate to a displacement assembly that includes a housing that defines a passage to be in fluid communication with a pressurized fluid supply proximate to a first end of the passage. The displacement assembly also includes a displacement mechanism slidably coupled with the housing to reciprocate in the passage from a first orientation where the displacement mechanism is proximate to the first end of the passage toward a second orientation where the displacement mechanism is proximate to a second end of the passage opposite the first end. The displacement mechanism and the housing define a seal for preventing pressurized fluid from the pressurized fluid supply from migrating through the passage when the displacement mechanism is in the first orientation. The displacement mechanism and the housing allow pressurized fluid to migrate through the passage when the displacement mechanism is in the second orientation.

20 Claims, 12 Drawing Sheets

(56) References Cited

U.S. PATENT DOCUMENTS

| | | | | |
|---|---|---|---|---|
| 2005/0109542 | A1* | 5/2005 | Downton | E21B 7/062 175/73 |
| 2009/0223716 | A1* | 9/2009 | Eppink | E21B 7/062 175/25 |
| 2013/0299245 | A1* | 11/2013 | Gentry | E21B 10/322 175/57 |
| 2015/0159437 | A1* | 6/2015 | Crowley | E21B 4/02 175/45 |

OTHER PUBLICATIONS

International Preliminary Report on Patentability issued in International Patent application PCT/US2016/017638 dated Aug. 15, 2017, 11 pages.

* cited by examiner

DISPLACEMENT ASSEMBLY WITH A DISPLACEMENT MECHANISM DEFINING AN EXHAUST PATH THERETHROUGH

CROSS REFERENCE TO RELATED APPLICATIONS

This application claims the benefit of and priority to U.S. Provisional Patent Application No. 62/116,537, filed on Feb. 15, 2015, the entire disclosure of which is incorporated herein by reference.

BACKGROUND

Oil wells are created by drilling a hole into the earth, in some cases using a drilling rig that rotates a drill string (e.g., drill pipe) having a drill bit attached thereto. In other cases, the drilling rig does not rotate the drill bit. For example, the drill bit can be rotated down-hole. The drill bit, aided by the weight of pipes (e.g., drill collars) cuts into rock within the earth. Drilling fluid (e.g., mud) is pumped into the drill pipe and exits at the drill bit. The drilling fluid may be used to cool the bit, lift rock cuttings to the surface, at least partially prevent destabilization of the rock in the wellbore, and/or at least partially overcome the pressure of fluids inside the rock so that the fluids do not enter the wellbore. Other equipment can also be used for evaluating formations, fluids, production, other operations, and so forth.

SUMMARY

Aspects of the disclosure can relate to a displacement assembly that includes a housing that defines a passage to be in fluid communication with a pressurized fluid supply proximate to a first end of the passage. The displacement assembly also includes a displacement mechanism slidably coupled with the housing to reciprocate in the passage from a first orientation where the displacement mechanism is proximate to the first end of the passage toward a second orientation where the displacement mechanism is proximate to a second end of the passage opposite the first end. The displacement mechanism and the housing define a seal for preventing pressurized fluid from the pressurized fluid supply from migrating through the passage when the displacement mechanism is in the first orientation. The displacement mechanism and the housing allow pressurized fluid to migrate through the passage when the displacement mechanism is in the second orientation.

Aspects of the disclosure can also relate to a displacement assembly that includes a housing that defines a passage to be in fluid communication with a pressurized fluid supply proximate to a first end of the passage. The displacement assembly also includes a piston slidably coupled with the housing to reciprocate in the passage from a first orientation where the piston is proximate to the first end of the passage toward a second orientation where the piston is proximate to a second end of the passage opposite the first end. The piston and the housing define a seal for preventing pressurized fluid from the pressurized fluid supply from migrating through the passage when the piston is in the first orientation. The piston and the housing allow pressurized fluid to migrate through the passage when the piston is in the second orientation.

Aspects of the disclosure can further relate to a displacement assembly that includes a housing that defines a passage to be in fluid communication with a pressurized fluid supply proximate to a first end of the passage. The displacement assembly also includes a displacement mechanism slidably coupled with the housing to reciprocate in the passage from a first orientation where the displacement mechanism is proximate to the first end of the passage toward a second orientation where the displacement mechanism is proximate to a second end of the passage opposite the first end. The displacement mechanism and the housing define a seal for preventing pressurized fluid from the pressurized fluid supply from migrating through the passage when the displacement mechanism is in the first orientation. The displacement mechanism defines an exhaust path that connects the first end of the passage to the second end of the passage when the displacement mechanism is in the second orientation that allows the pressurized fluid to migrate through the passage from the first end of the passage to the second end of the passage when the displacement mechanism is in the second orientation. The displacement mechanism defines a chamber at the end of the exhaust path. The displacement assembly further includes a valve for fluid communication with the pressurized fluid supply. The value can be biased to move to a first position when the displacement mechanism is in the second orientation, and to move to a second position when the displacement mechanism is in the first orientation.

This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of displacement assembly with a displacement mechanism defining an exhaust path therethrough are described with reference to the following figures. The same numbers are used throughout the figures to reference like features and components.

DETAILED DESCRIPTION

Figure 1:
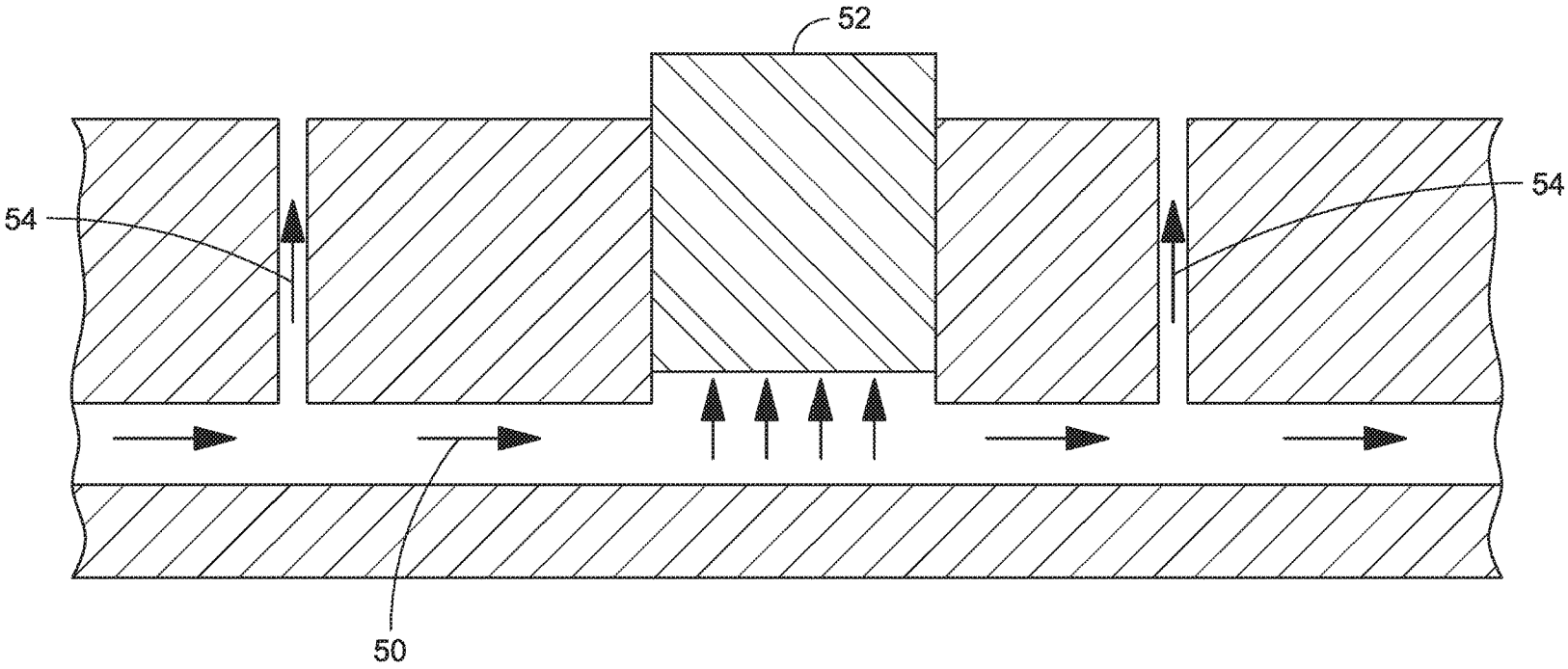
FIG. 1 illustrates a hydraulic piston for a steering system.

Various steering techniques can be used for directional drilling systems. These systems employ down hole equipment that responds to commands (e.g., from surface equipment) and steers into a desired direction. For example, pistons may be used to generate force against a borehole wall or to cause angular displacement of one steerable system component with respect to another to cause a drill bit to move in the desired direction of deviation. The pistons can be actuated using, for example, drilling fluid pumped downwardly through a drill string. When actuating a hydraulic pad or piston in a bias unit for a steering system, an exhaust line can be included somewhere in the supply line to allow the piston or pad to return back to its closed (e.g., unactuated) position. In this manner, full steerability can be achieved by providing a full range of motion in the hole. However, the exhaust is continuously open, resulting in a constant pressure leak that can lead to inefficiencies and/or a reduction in available pressure behind the pad or piston. With reference to FIG. 1, when pressure from the flow of drilling fluid 50 is applied to the underside of a piston 52, the piston 52 is pushed out towards the wall of a formation, creating a steering force. To allow the piston 52 to return back to its starting position as the drill string rotates, the pressure beneath the piston is reduced as the exhaust 54 allows the flow to be diverted and released somewhere else. However, this configuration may prevent a full supply pressure from being applied to the underside of the piston, decreasing the effectiveness and/or efficiency of the steering system.

The present disclosure describes apparatus, systems, and techniques that can provide one or more exhaust flow channels in the body of the piston itself. The flow of fluid to annular can be choked by one or more sealing members (e.g., pads) that seal against the piston. When pressure pushes the piston outward, the exhausts are opened gradually against the pads allowing fluid to flow out of the piston. The more the piston moves, the more the exhaust opens. As described herein, drilling applications are provided by way of example and are not meant to limit the present disclosure. In other embodiments, systems, techniques, and apparatus as described herein can be used with other down-hole operations, such as with equipment for applications including, but not necessarily limited to: well testing, simulation, completion, and so forth. Further, such systems, techniques, and apparatus can be used in other applications not necessarily related to down-hole operations. For example, in some embodiments, a displacement assembly as described herein can be used to implement a damped valve (e.g., for a plumbing application).

Figure 2:
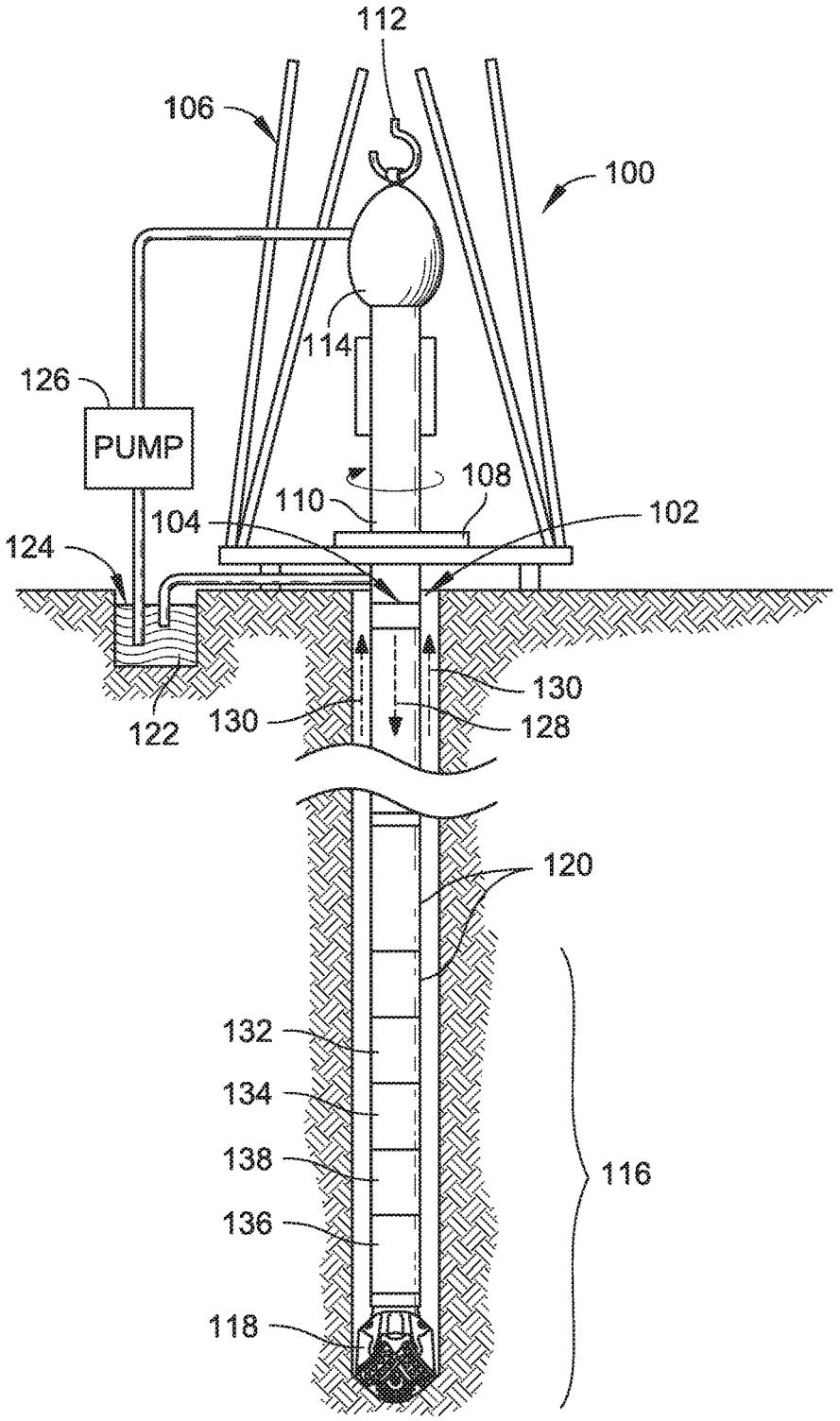
FIG. 2 illustrates an example system in which embodiments of a displacement assembly with a displacement mechanism defining an exhaust path therethrough can be implemented.

FIG. 2 depicts a wellsite system 100 in accordance with one or more embodiments of the present disclosure. The wellsite can be onshore or offshore. A borehole 102 is formed in subsurface formations by directional drilling. A drill string 104 extends from a drill rig 106 and is suspended within the borehole 102. In some embodiments, the wellsite system 100 implements directional drilling using a rotary steerable system (RSS). For instance, the drill string 104 is rotated from the surface, and down-hole devices move the end of the drill string 104 in a desired direction. The drill rig 106 includes a platform and derrick assembly positioned over the borehole 102. In some embodiments, the drill rig 106 includes a rotary table 108, kelly 110, hook 112, rotary swivel 114, and so forth. For example, the drill string 104 is rotated by the rotary table 108, which engages the kelly 110 at the upper end of the drill string 104. The drill string 104 is suspended from the hook 112 using the rotary swivel 114, which permits rotation of the drill string 104 relative to the hook 112. However, this configuration is provided by way of example and is not meant to limit the present disclosure. For instance, in other embodiments a top drive system is used.

A bottom hole assembly (BHA) 116 is suspended at the end of the drill string 104. The bottom hole assembly 116 includes a drill bit 118 at its lower end. In embodiments of the disclosure, the drill string 104 includes a number of drill pipes 120 that extend the bottom hole assembly 116 and the drill bit 118 into subterranean formations. Drilling fluid (e.g., mud) 122 is stored in a tank and/or a pit 124 formed at the wellsite. The drilling fluid can be water-based, oil-based, and so on. A pump 126 displaces the drilling fluid 122 to an interior passage of the drill string 104 via, for example, a port in the rotary swivel 114, causing the drilling fluid 122 to flow downwardly through the drill string 104 as indicated by directional arrow 128. The drilling fluid 122 exits the drill string 104 via ports (e.g., courses, nozzles) in the drill bit 118, and then circulates upwardly through the annulus region between the outside of the drill string 104 and the wall of the borehole 102, as indicated by directional arrows 130. In this manner, the drilling fluid 122 cools and lubricates the drill bit 118 and carries drill cuttings generated by the drill bit 118 up to the surface (e.g., as the drilling fluid 122 is returned to the pit 124 for recirculation).

In some embodiments, the bottom hole assembly 116 includes a logging-while-drilling (LWD) module 132, a measuring-while-drilling (MWD) module 134, a rotary steerable system 136, a motor, and so forth (e.g., in addition to the drill bit 118). The logging-while-drilling module 132 can be housed in a drill collar and can contain one or a number of logging tools. It should also be noted that more than one LWD module and/or MWD module can be employed (e.g. as represented by another logging-while-drilling module 138). In embodiments of the disclosure, the logging-while drilling modules 132 and/or 138 include capabilities for measuring, processing, and storing information, as well as for communicating with surface equipment, and so forth.

The measuring-while-drilling module 134 can also be housed in a drill collar, and can contain one or more devices for measuring characteristics of the drill string 104 and drill bit 118. The measuring-while-drilling module 134 can also include components for generating electrical power for the down-hole equipment. This can include a mud turbine generator (also referred to as a "mud motor") powered by the flow of the drilling fluid 122. However, this configuration is provided by way of example and is not meant to limit the present disclosure. In other embodiments, other power and/or battery systems can be employed. The measuring-while-drilling module 134 can include one or more of the following measuring devices: a weight-on-bit measuring device, a torque measuring device, a vibration measuring device, a shock measuring device, a stick slip measuring device, a direction measuring device, an inclination measuring device, and so on.

In embodiments of the disclosure, the wellsite system 100 is used with controlled steering or directional drilling. For example, the rotary steerable system 136 is used for directional drilling. As used herein, the term "directional drilling" describes intentional deviation of the wellbore from the path it would naturally take. Thus, directional drilling refers to steering the drill string 104 so that it travels in a desired direction. In some embodiments, directional drilling is used for offshore drilling (e.g., where multiple wells are drilled from a single platform). In other embodiments, directional drilling enables horizontal drilling through a reservoir, which enables a longer length of the wellbore to traverse the reservoir, increasing the production rate from the well. Further, directional drilling may be used in vertical drilling operations. For example, the drill bit 118 may veer off of a planned drilling trajectory because of the unpredictable nature of the formations being penetrated or the varying forces that the drill bit 118 experiences. When such deviation occurs, the wellsite system 100 may be used to guide the drill bit 118 back on course.

FIGS. 3 through 8 depict a displacement assembly that can be used with, for example, a wellsite system (e.g., the wellsite system 100 described with reference to FIG. 1). For instance, the displacement assembly can be included with a drill assembly comprising a bottom hole assembly suspended at the end of a drill string (e.g., in the manner of the bottom hole assembly 116 suspended from the drill string 104 depicted in FIG. 1). In some embodiments, the drill assembly is implemented using a drill bit. However, this configuration is provided by way of example only and is not meant to limit the present disclosure. In other embodiments, different working implement configurations are used. Further, use of drill assemblies in accordance with the present disclosure is not limited to wellsite systems described herein. Drill assemblies can be used in other various cutting and/or crushing applications, including earth boring applications employing rock scraping, crushing, cutting, and so forth.

The drill assembly includes a body for receiving a flow of drilling fluid. The body comprises one or more crushing and/or cutting implements, such as conical cutters and/or bit cones having spiked teeth (e.g., in the manner of a roller-cone bit). In this configuration, as the drill string is rotated, the bit cones roll along the bottom of the borehole in a circular motion. As they roll, new teeth come in contact with the bottom of the borehole, crushing the rock immediately below and around the bit tooth. As the cone continues to roll, the tooth then lifts off the bottom of the hole and a high-velocity drilling fluid jet strikes the crushed rock chips to remove them from the bottom of the borehole and up the annulus. As this occurs, another tooth makes contact with the bottom of the borehole and creates new rock chips. In this manner, the process of chipping the rock and removing the small rock chips with the fluid jets is continuous. The teeth intermesh on the cones, which helps clean the cones and enables larger teeth to be used. A drill assembly comprising a conical cutter can be implemented as a steel milled-tooth bit, a carbide insert bit, and so forth. However, roller-cone bits are provided by way of example only and are not meant to limit the present disclosure. In other embodiments, a drill assembly is configured differently. For example, the body of the bit comprises one or more polycrystalline diamond compact (PDC) cutters that shear rock with a continuous scraping motion.

In embodiments of the disclosure, the body of the drill assembly defines one or more nozzles that allow the drilling fluid to exit the body (e.g., proximate to the crushing and/or cutting implements). The nozzles allow drilling fluid pumped through, for example, a drill string to exit the body. For example, as discussed with reference to FIG. 1, drilling fluid 122 is furnished to an interior passage of drill string 104 by pump 126 and flows downwardly through drill string 104 to drill bit 118 of bottom hole assembly 116, which can be implemented using a drill assembly. Drilling fluid 122 then exits drill string 104 via nozzles in drill bit 118 (e.g., via the nozzles of the drill assembly), and circulates upwardly through the annulus region between the outside of drill string 104 and the wall of borehole 102. In this manner, rock cuttings can be lifted to the surface, destabilization of the rock in the wellbore can be at least partially prevented, the pressure of fluids inside the rock can be at least partially overcome so that the fluids do not enter the wellbore, and so forth.

The drill assembly also includes one or more extendable displacement mechanisms, such as a piston mechanism that can be selectively actuated by an actuator to displace a pad toward, for instance, a borehole wall to cause the drill assembly to move in a desired direction of deviation. In embodiments of the disclosure, the displacement mechanism is actuated by drilling fluid routed through the body of the drill assembly. For example, as discussed with reference to FIG. 1, drilling fluid 122 is used to move a piston, which changes the orientation of drill bit 118 (e.g., changing the drilling axis orientation with respect to a longitudinal axis of bottom hole assembly 116). The displacement mechanism may be employed to control a directional bias and/or an axial orientation of the drill assembly. Displacement mechanisms may be arranged, for example, to point the drill assembly and/or to push the drill assembly. In some embodiments, a displacement assembly is deployed by a drilling system using a rotary steerable system that rotates with a number of displacement mechanisms (e.g., rotary steerable system 136 described with reference to FIG. 1). It should be noted that such a rotary steerable system can be used in conjunction with stabilizers, such as non-rotating stabilizers, and so on.

In some embodiments, a displacement mechanism can be positioned proximate to a bit of a drive assembly. However, in other embodiments, a displacement mechanism can be positioned at various locations along a drill string, a bottom hole assembly, and so on. For example, in some embodiments, a displacement mechanism is positioned in a rotary steerable system 136 (FIG. 1), while in other embodiments, a displacement mechanism is positioned at or near the end of bottom hole assembly 116 (e.g., proximate to the drill bit 118). In some embodiments, the drill assembly can include one or more filters that filter the drilling fluid (e.g., upstream of the displacement assembly with respect to the flow of the drilling fluid).

Figure 3:
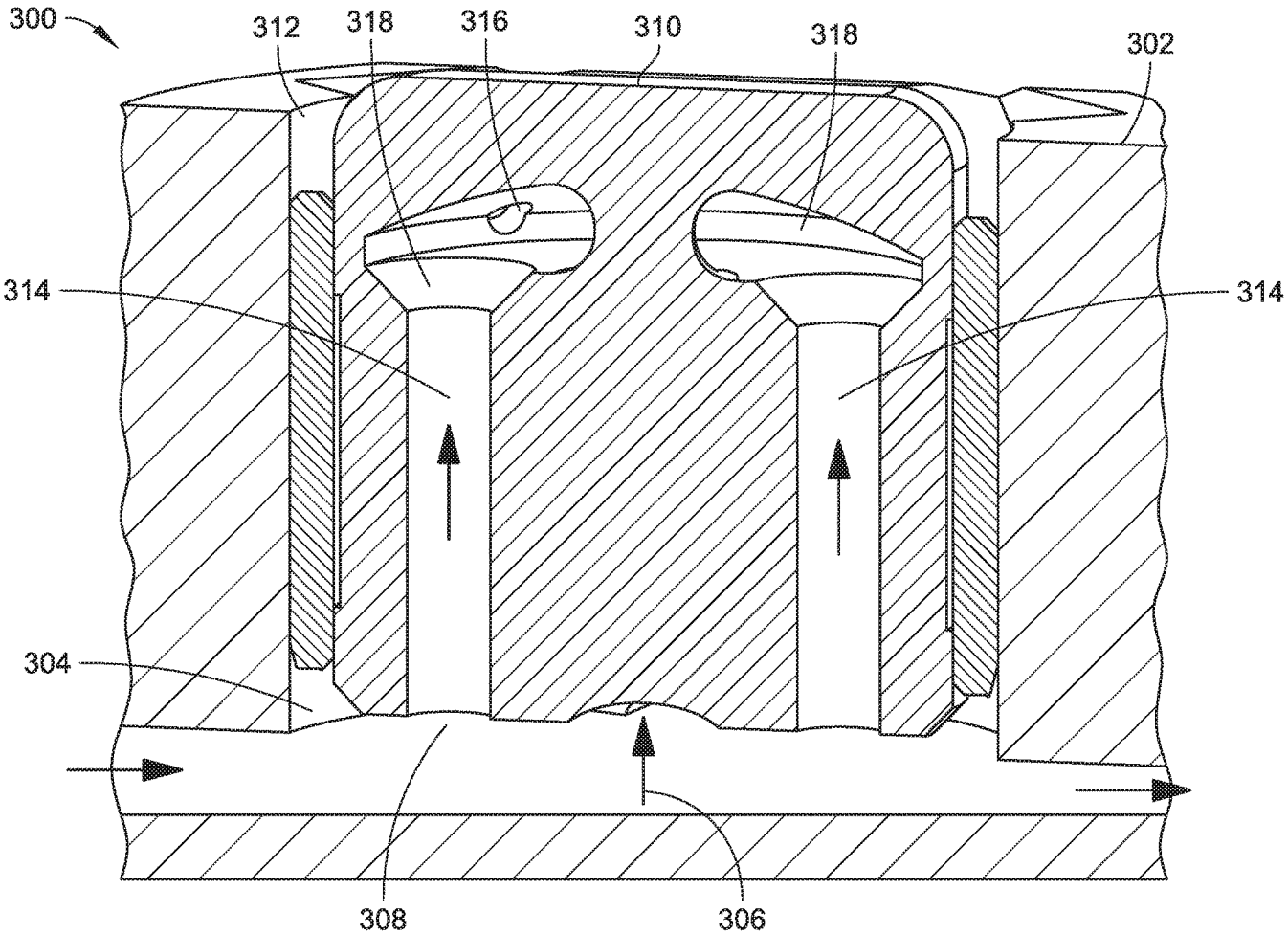
FIG. 3 is a partial cross-sectional side elevation view illustrating an example displacement assembly in accordance with one or more embodiments.
Figure 4:
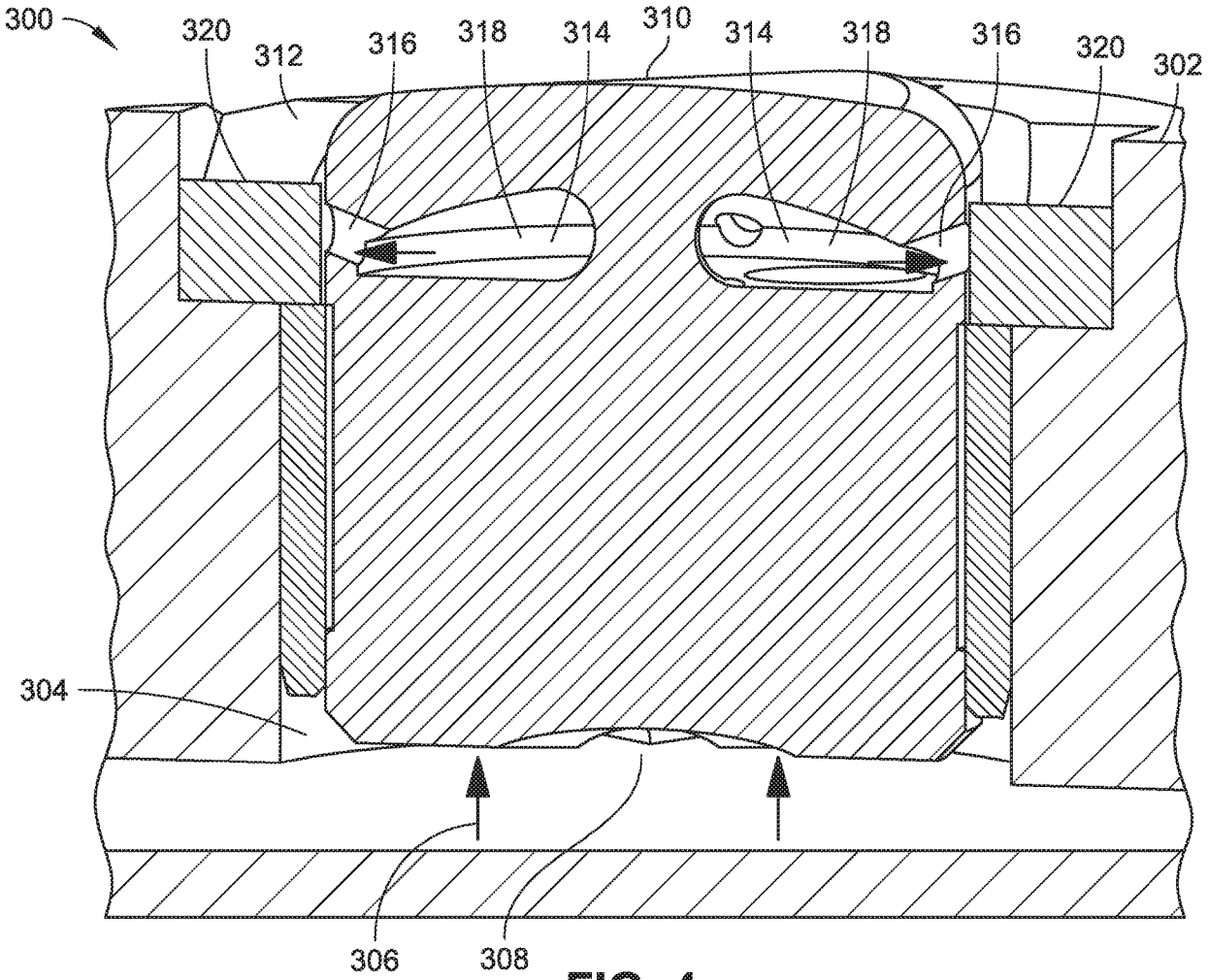
FIG. 4 is another partial cross-sectional side elevation view of the example displacement assembly illustrated in FIG. 3.
Figure 5:
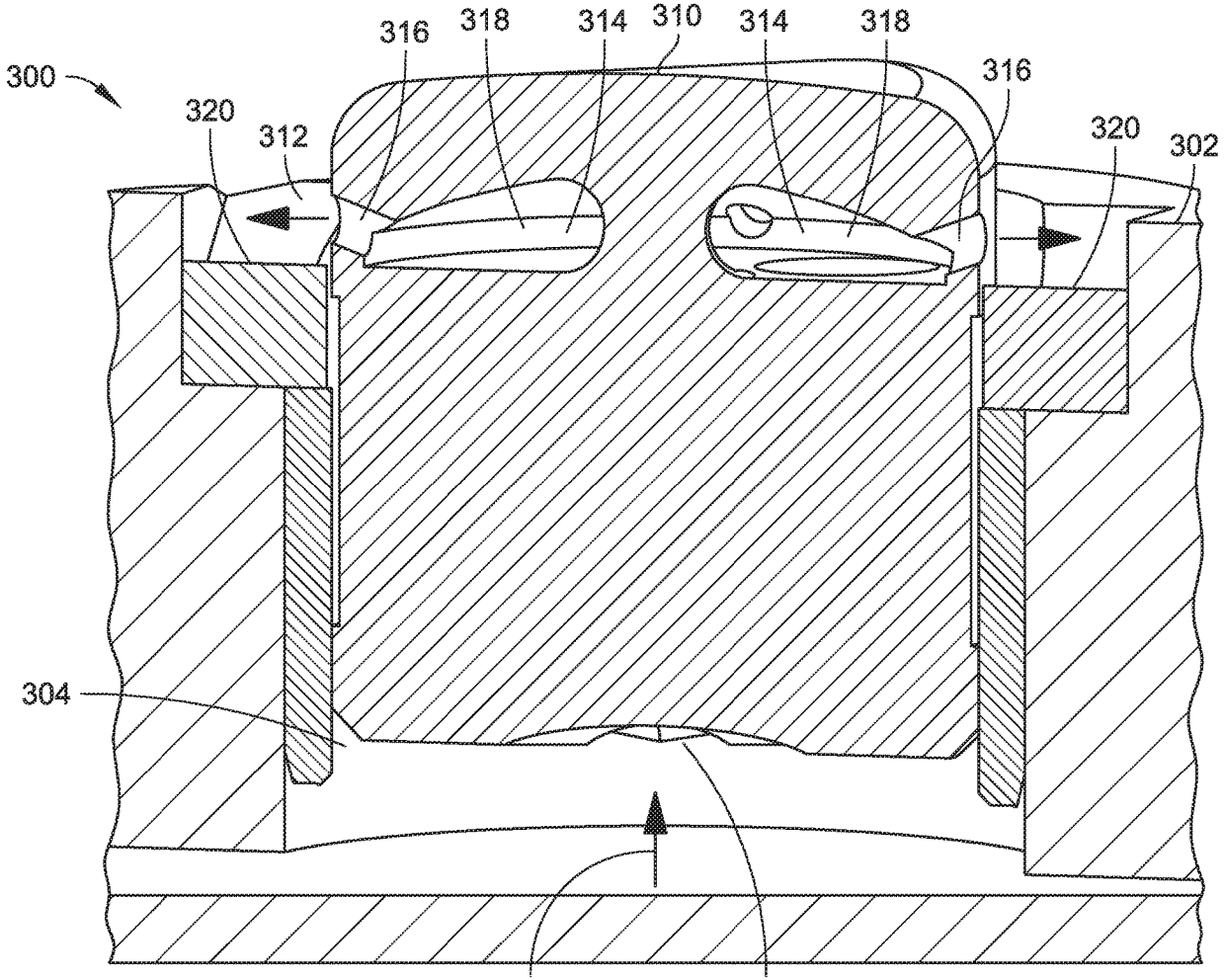
FIG. 5 is a further partial cross-sectional side elevation view of the example displacement assembly illustrated in FIG. 3.

Referring generally to FIGS. 3 through 12, displacement assemblies are described. A displacement assembly 300 includes a housing 302 (e.g., as part of a drill collar) defining a passage 304 to be in fluid communication with a pressurized fluid supply (e.g., a supply of pressurized fluid such as drilling fluid 306) proximate to a first end 308 of the passage 304. The displacement assembly 300 also includes a displacement mechanism (e.g., a piston 310 and/or a pad) slidably coupled with the housing 302 to reciprocate in the passage 304 from a first orientation where the piston 310 is proximate to the first end 308 of the passage 304 (e.g., as shown in FIGS. 3 and 4) toward a second orientation where the piston 310 is proximate to a second end 312 of the passage 304 opposite the first end 308 (e.g., as shown in FIG. 5). In embodiments of the disclosure, the piston 310 and the housing 302 define a seal for preventing the drilling fluid 306 from migrating through the passage 304 from the first end 308 of the passage 304 to the second end 312 of the passage 304 when the piston 310 is in the first orientation. Further, the piston 310 and the housing 302 allow the drilling fluid 306 to migrate through the passage 304 from the first end 308 of the passage 304 to the second end 312 of the passage 304 when the piston 310 is in the second orientation. For example, the piston 310 defines one or more exhaust paths 314 connecting the first end 308 of the passage 304 to the second end 312 of the passage 304 when the piston 310 is in the second orientation.

Referring now to FIGS. 3 and 4, fluid flow past the bottom of the piston 310 applies a force pushing the piston 310 outwardly (e.g., upwards), while also flowing to exhaust ports 316 in the piston. In this example, the exhaust flow can be collected in one or more chambers 318 inside the piston 310. It should be noted that in other embodiments, the piston 310 does not necessarily include chambers 318. In the orientation shown in FIG. 4, the exhaust ports 316 are immediately adjacent to respective sealing surfaces (e.g., provided by pads 320) on the housing, and there is no leak path for the exhaust. Thus, more (e.g., full) pressure is being applied to the bottom of the piston 310. For example, with reference to FIG. 4, the pads 320 can be seen sealing against the outer surface of the piston 310 and preventing the exhaust from escaping. In some embodiments, the pads 320 can be constructed from a material that is resistant to erosion (e.g., due to the high velocities of the fluid when it escapes). For example, the pads 320 can be constructed from one or more erosion-resistant materials, including, but not necessarily limited to: a tungsten carbide material, a polycrystalline diamond compact (PDC) material, a diamond material, and so forth. It should be noted that the pads 320 are provided by way of example and are not meant to limit the present disclosure. In other embodiments, a sealing surface can be provided by a ring and/or a coating on, for example, the housing 302.

Referring to FIG. 5, as the pressure builds behind the piston 310, the piston 310 is pushed outwardly (e.g., towards the formation wall). This movement causes the exhaust ports 316 to become uncovered by the pads 320. It should be noted that while the ports 316 are shown as generally circular-shaped in the accompanying figures, this shape is provided by way of example and is not meant to limit the present disclosure. In other embodiments, differently shaped ports 316 can be employed, including, but not necessarily limited to: rectangular-shaped (e.g., square-shaped) ports, elliptically-shaped ports, triangularly-shaped ports, and so forth.

Figure 9:
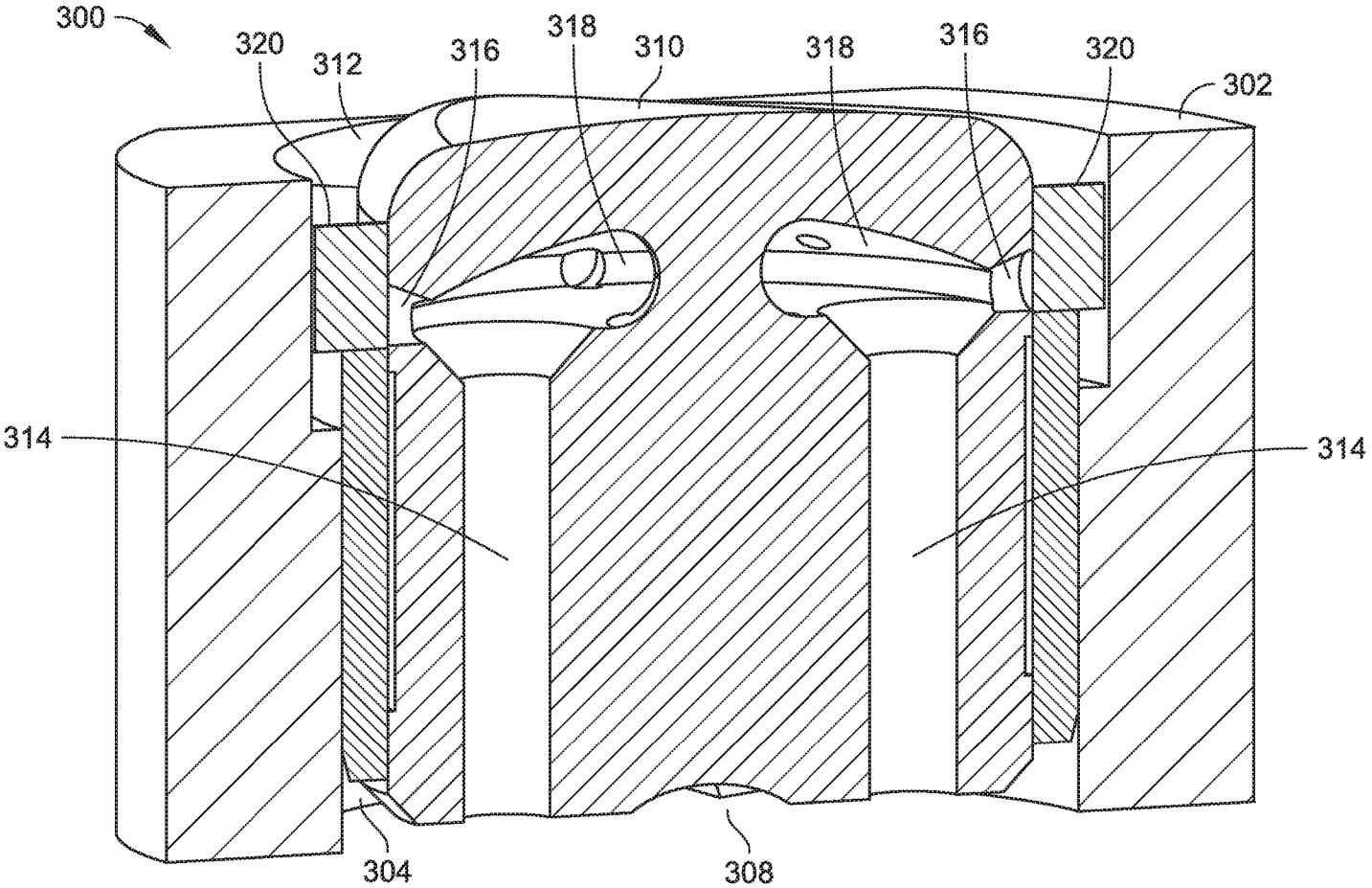
FIG. 9 is a partial cross-sectional side elevation view illustrating an example displacement assembly in accordance with one or more embodiments.
Figure 10:
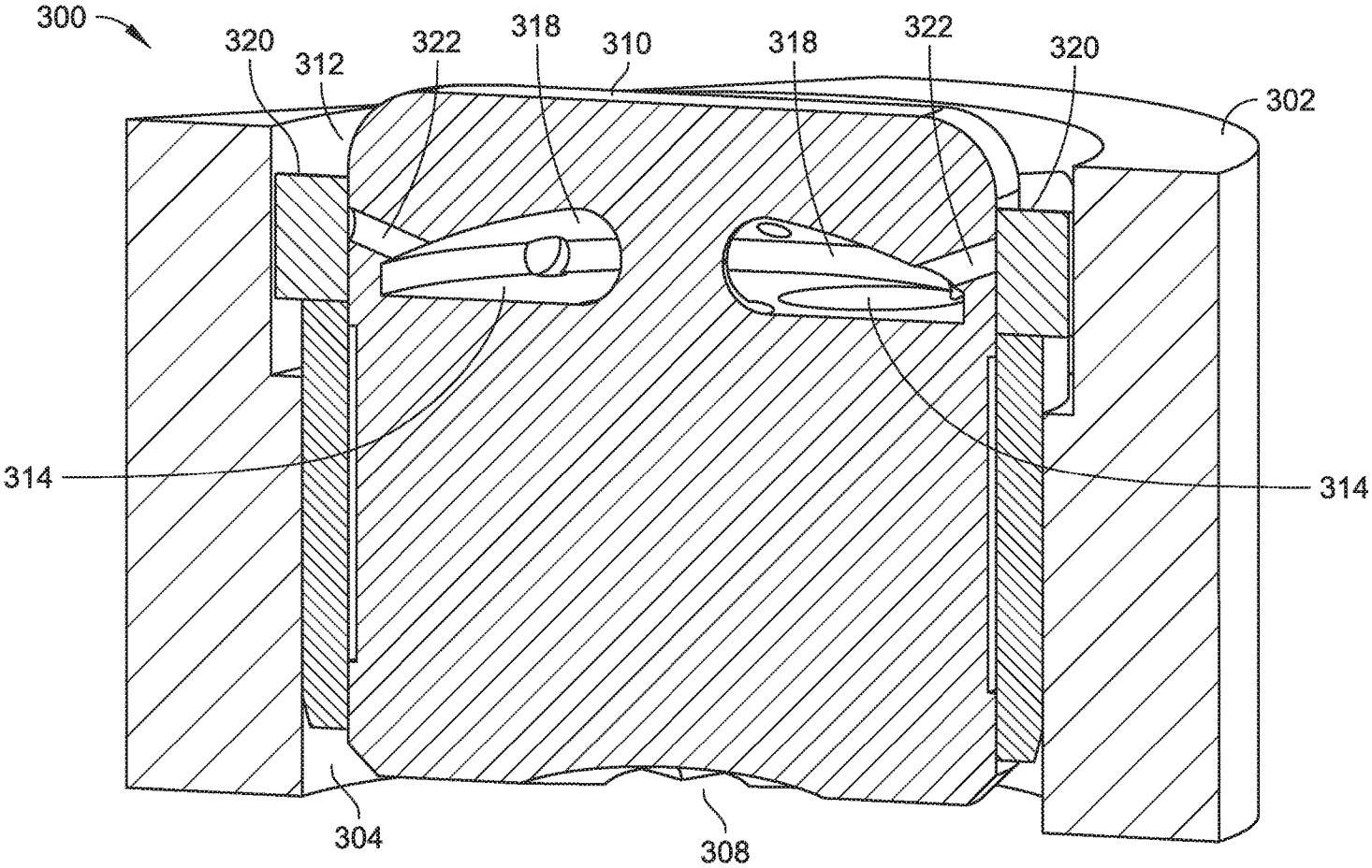
FIG. 10 is another partial cross-sectional side elevation view of the example displacement assembly illustrated in FIG. 9.

Referring now to FIGS. 9 and 10, in some embodiments, multiple exhaust ports 316 and 318 can be included along the length of the piston 310 (e.g., at different levels so that additional ports can be successively uncovered as the piston 310 extends in the passage). For instance, first exhaust ports 316 can be included distal to the second end 312 of the passage 304 (e.g., as shown in FIG. 9), second exhaust ports 322 can be included proximal to the second end 312 of the passage 304 (e.g., as shown in FIG. 10), and so forth. Due to the flow behind the piston 310 having an escape route to the annulus, the pressure applied on the piston 310 decreases, which both slows outward travel of the piston 310 and allows the piston 310 to return back to its starting position (e.g., by the reactive force of the formation wall). As the piston 310 is returned, the exhaust holes 316 and 322 are gradually covered (e.g., by the pads 320), reducing the exhaust flow, increasing the pressure behind the piston 310, and reducing the force with which the piston 310 is returned. In this manner, wear on components of the displacement assembly 300 can be reduced or minimized. Then, the cycle can be repeated.

Figure 6:
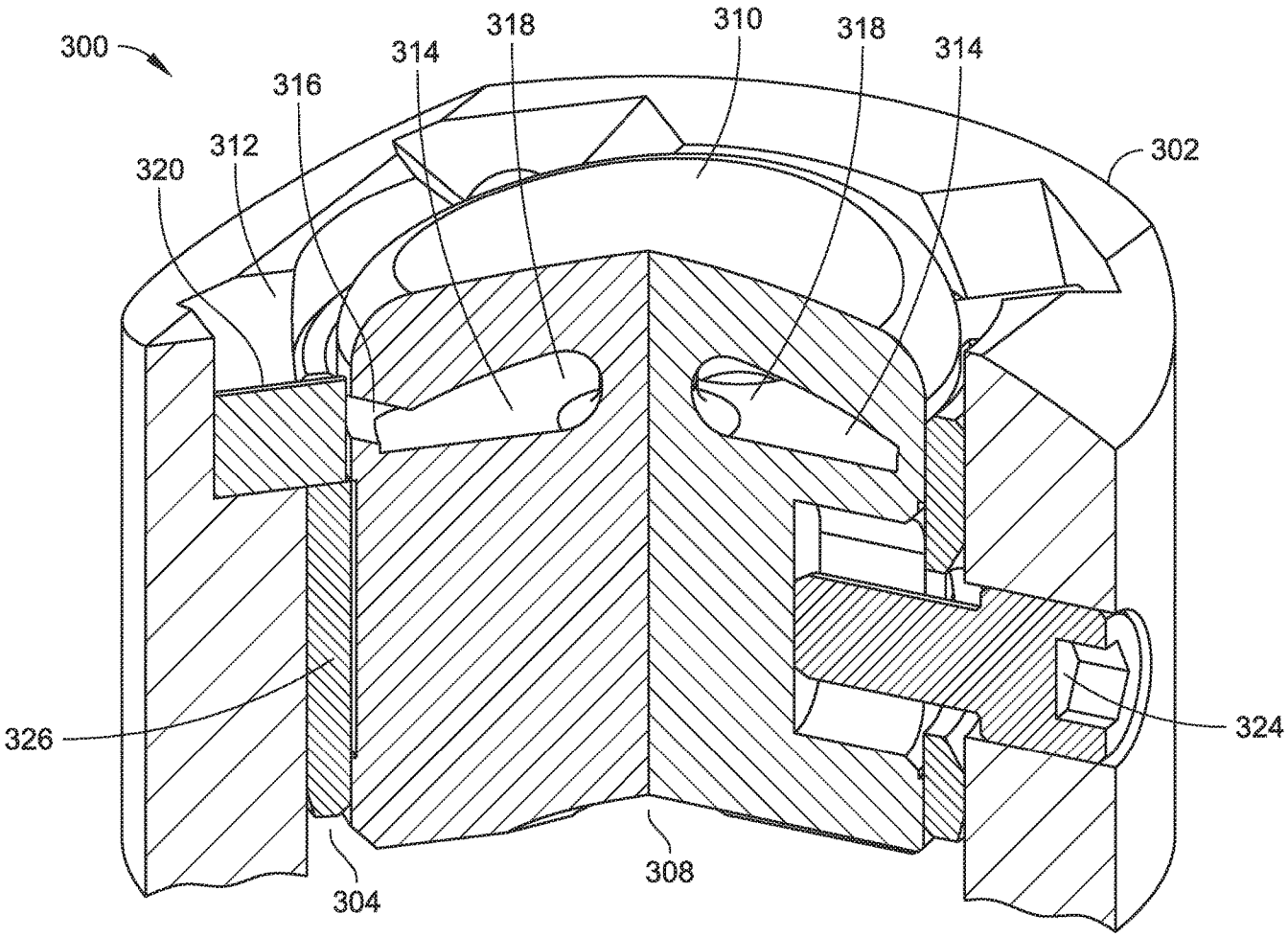
FIG. 6 is a partial cross-sectional perspective view illustrating an example displacement assembly in accordance with one or more embodiments.
Figure 7:
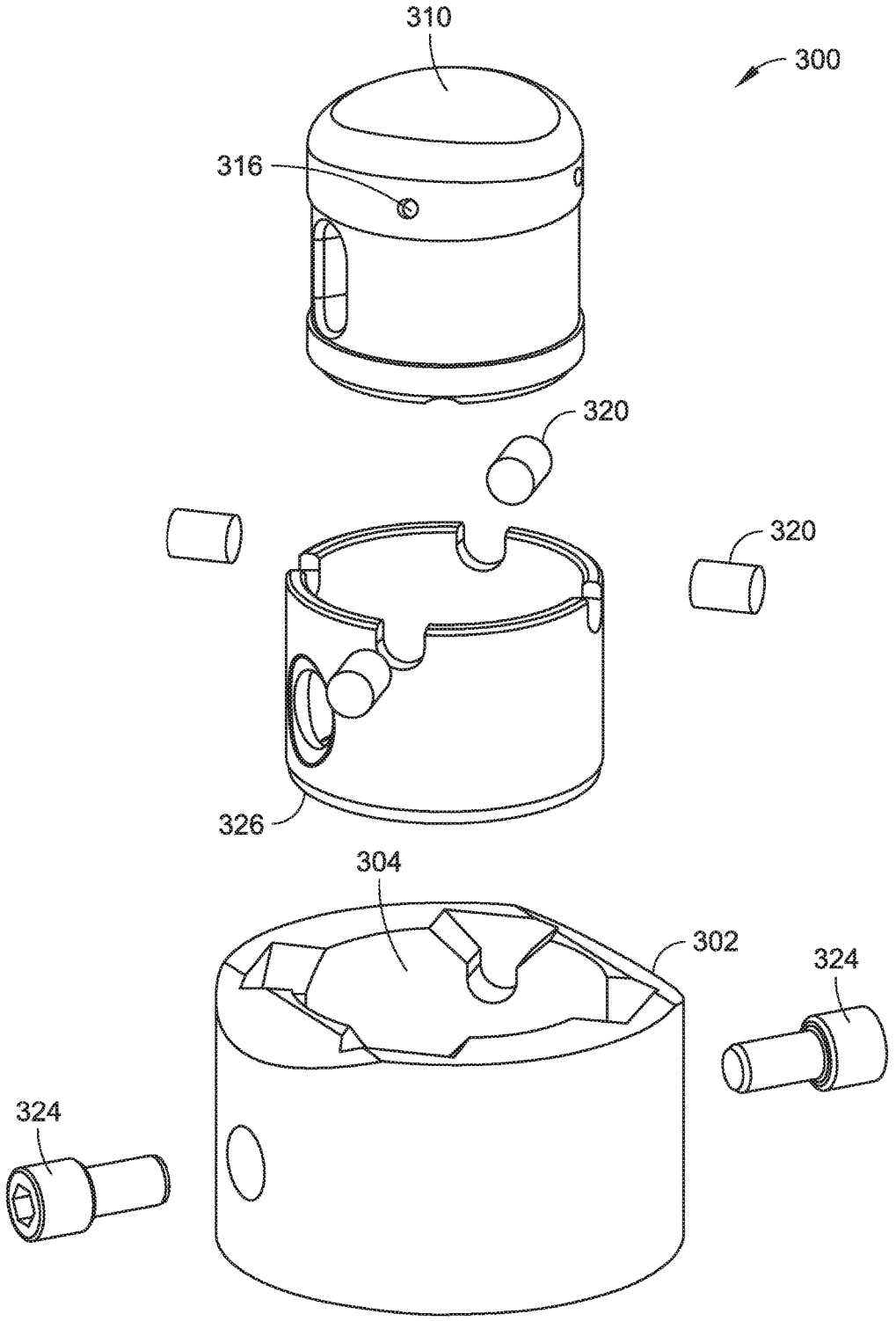
FIG. 7 is an exploded perspective view of the example displacement assembly illustrated in FIG. 6.
Figure 8:
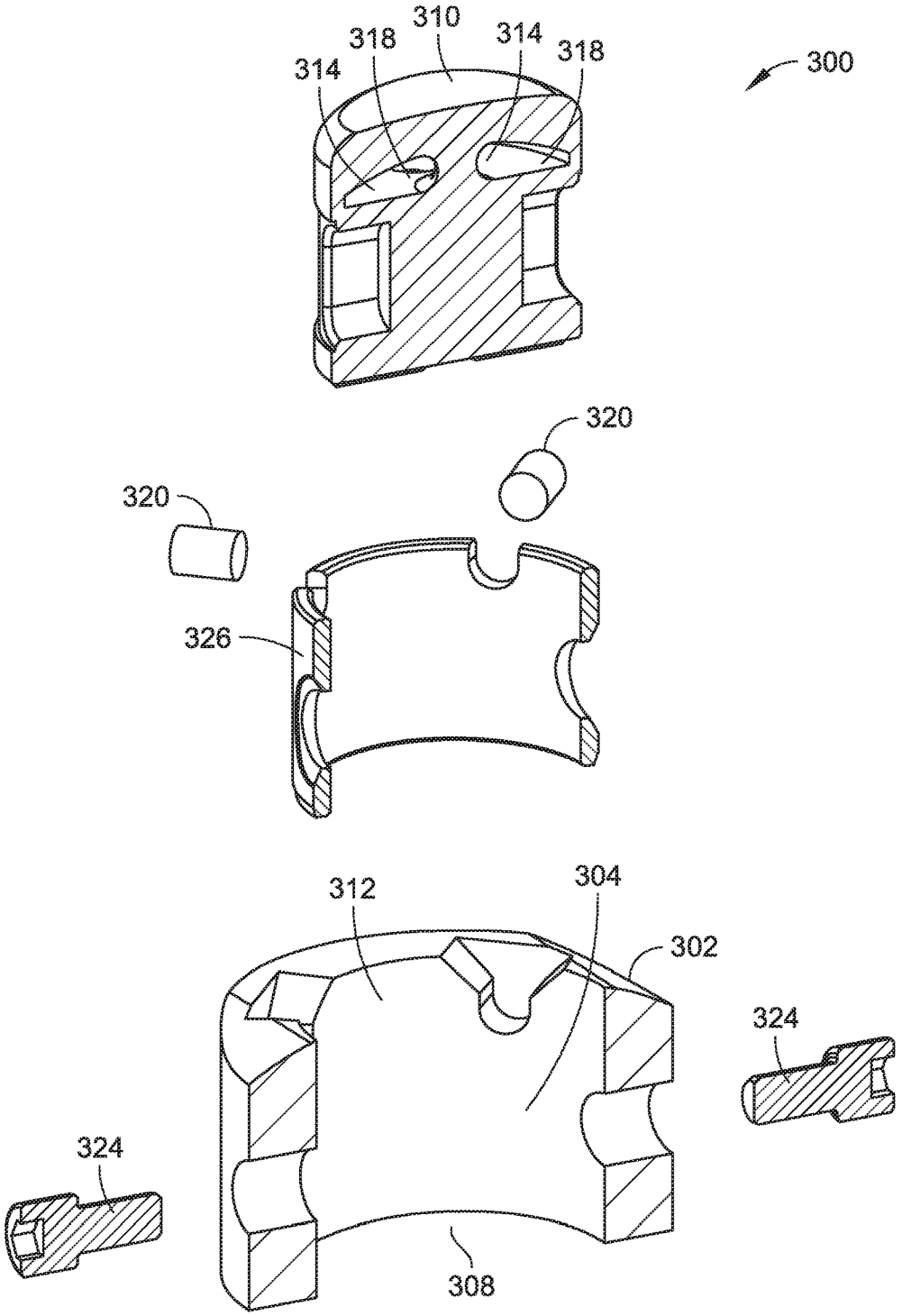
FIG. 8 is a partial cross-sectional exploded perspective view of the example displacement assembly illustrated in FIG. 6.

Referring to FIGS. 6 through 8, in some embodiments, a displacement assembly 300 can include one or more guides 324 (e.g., locking pins) to maintain an orientation (e.g., a rotational orientation) of the piston 310 with respect to the housing 302 as the piston 310 reciprocates in the housing 302. Further, the displacement assembly 300 can also include a sealing mechanism, a bearing guide, and so forth disposed between the piston 310 and the housing 302. For example, a sleeve 326 can be disposed between the piston 310 and the housing 302. In some embodiments, the sleeve 326 can be constructed from one or more erosion-resistant materials, including, but not necessarily limited to: a tungsten carbide material, a polycrystalline diamond compact (PDC) material, a diamond material, and so forth. Further, in implementations where a ring is used to provide a surface that seals against the piston 310, the ring can be positioned on top of the sleeve 326. In other embodiments, the sleeve 326 can include a sealing surface and/or define an erosion resistant sealing surface. However, it should be noted that a sleeve is provided by way of example and is not meant to limit the present disclosure. In other embodiments, a coating can be disposed between the piston 310 and the housing 302 (e.g., disposed on the piston 310 and/or on the housing 302). The coating can act as a sealing mechanism, a bearing guide, and so forth.

Figure 11:
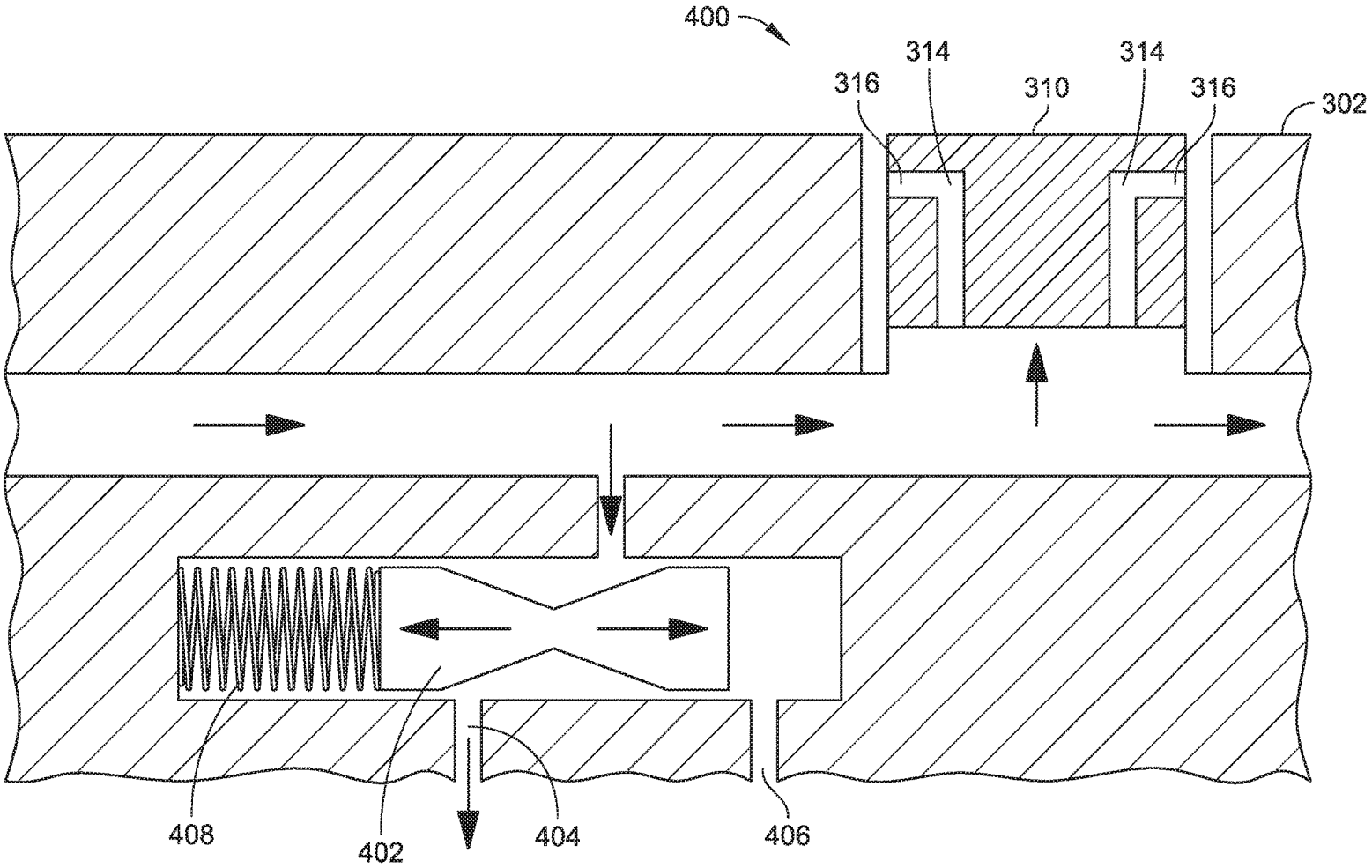
FIG. 11 is a partial cross-sectional side elevation view illustrating an example displacement assembly in accordance with one or more embodiments.

Referring now to FIG. 11, in some embodiments, a displacement assembly can be used to drive and/or control one or more other mechanisms. For instance, a displacement assembly can be implemented with a bi-stable valve, e.g., where an exhausting piston can vary pressure supplied to a valve. For instance, a displacement assembly 400 includes a housing 302 to be in fluid communication with a pressurized fluid supply, and a displacement mechanism (e.g., a piston 310) slidably coupled with the housing 302, where the piston 310 defines one or more exhaust paths 314 (e.g., as previously described). The displacement assembly can also include a valve 402, which can translate between one orientation, where fluid can be directed to an outlet 404, and another orientation, where fluid can be directed to an outlet 406. As previously described, fluid flow past the bottom of the piston 310 applies a force pushing the piston 310 outwardly while also flowing to exhaust ports 316 in the piston. When the exhaust ports 316 are immediately adjacent to the housing 302 and/or the pads 320, there is no leak path for the exhaust, and increased pressure is applied to the bottom of the piston 310. In this configuration, the valve 402 can be pushed by this pressure (e.g., against a biasing member, such as a spring 408) toward a position where fluid is directed to the outlet 404 (e.g., as shown in FIG. 11). Then, as pressure builds behind the piston 310, the piston 310 is pushed outwardly causing the exhaust ports 316 to become uncovered. In this configuration, the pressure drop across the piston 310 due to the opened exhaust ports allows the spring 408 to shuttle the valve 402 across toward another position where fluid is directed to the outlet 406.

Figure 12:
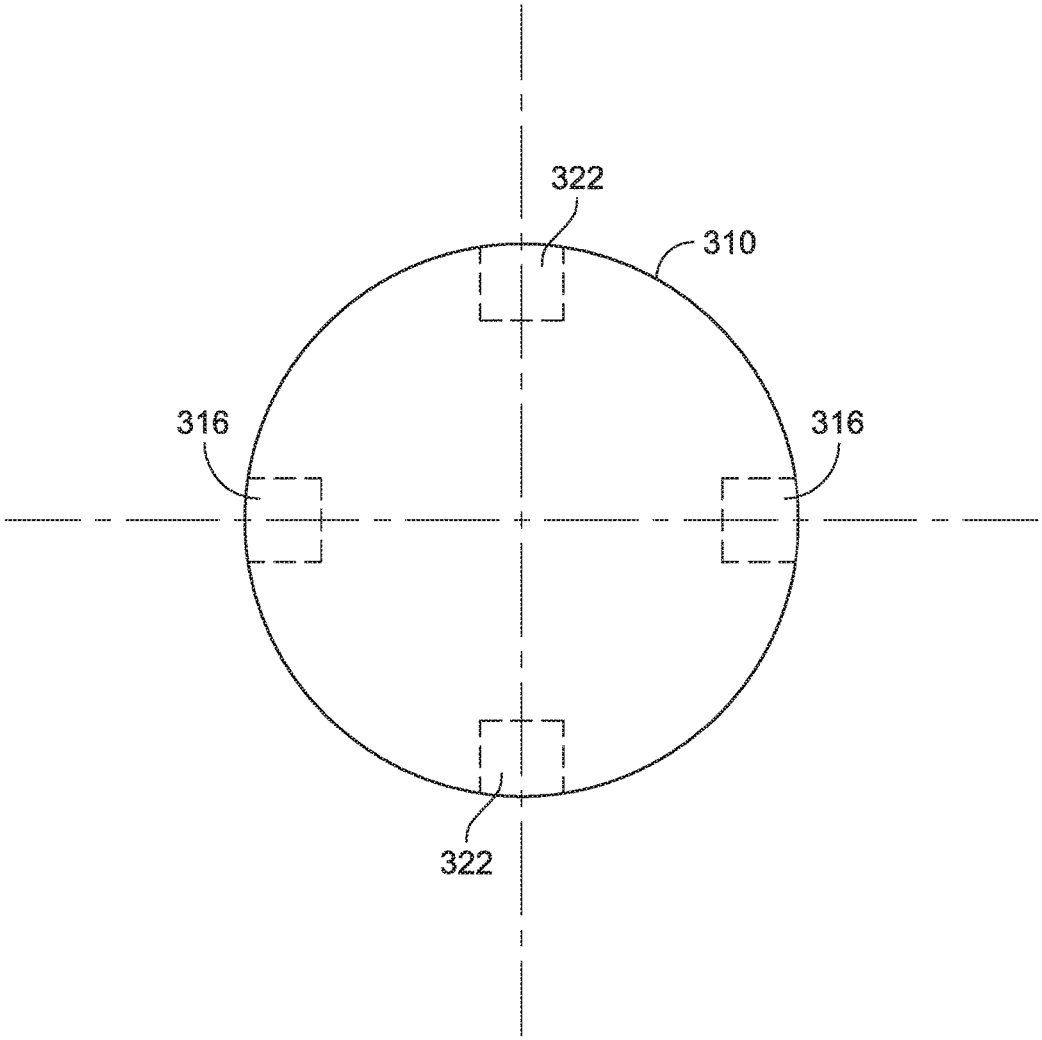
FIG. 12 is a top plan view illustrating a piston for a displacement assembly in accordance with one or more embodiments.

With reference to FIG. 12, in some embodiments, exhaust ports 316 in a piston 310 can be symmetrical to balance the forces on the piston 310 from the exhausted pressurized fluid. For example, first and second exhaust ports 316 are disposed on opposite sides of a cylindrical piston 310 (e.g., at diametrically opposed positions with respect to a longitudinal axis of the piston 310). Further, when additional exhaust ports are included (e.g., exhaust ports 322 as described with reference to FIGS. 9 and 10), these exhaust ports can also be symmetrical. For instance, the exhaust ports 322 can be in-line with the exhaust ports 316 and/or can be offset from the exhaust ports 316 (e.g., as shown in FIG. 12). It should also be noted that while the displacement assemblies 300 and 400 described herein have been discussed with some specificity as implemented in a downhole drilling environment, these configurations are provided by way of example and are not meant to limit the present disclosure. Thus, in other embodiments, the systems and techniques described herein can be used in other applications, including, but not necessarily limited to various hydraulic applications and so forth.

Although only a few example embodiments have been described in detail above, those skilled in the art will readily appreciate that many modifications are possible in the example embodiments without materially departing from a displacement assembly with a displacement mechanism defining an exhaust path therethrough. Features shown in individual embodiments referred to above may be used together in combinations other than those which have been shown and described specifically. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function.

What is claimed is:

1. A displacement assembly comprising:

a housing defining a passage to be in fluid communication with a pressurized fluid supply proximate to a first end of the passage, the housing having a housing longitudinal axis; and a displacement mechanism slidably coupled with the housing to reciprocate in the passage from a first orientation where the displacement mechanism is proximate to the first end of the passage toward a second orientation where the displacement mechanism is proximate to a second end of the passage opposite the first end, the displacement mechanism defining an exhaust path connecting the first end of the passage to the second end of the passage through an exhaust port when the displacement mechanism is in the second orientation that allows the pressurized fluid to migrate through the passage from the first end of the passage to the second end of the passage when the displacement mechanism is in the second orientation, the pressurized fluid exiting the exhaust port transverse to a displacement mechanism longitudinal axis of the displacement mechanism, the displacement mechanism longitudinal axis being transverse to the housing longitudinal axis, a terminal end of the exhaust port, from which the pressurized fluid exits the passage and the housing defining a seal for preventing pressurized fluid from the pressurized fluid supply from migrating through the passage from the first end of the passage to the second end of the passage when the displacement mechanism is in the first orientation.

2. The displacement assembly as recited in claim 1, wherein the displacement mechanism defines a chamber at an end of the exhaust path.

3. The displacement assembly as recited in claim 1, further comprising a sealing surface on the housing that prevents pressurized fluid from the pressurized fluid supply from migrating through the passage from the first end of the passage to the second end of the passage when the displacement mechanism is in the first orientation.

4. The displacement assembly as recited in claim 3, wherein the sealing surface comprises a pad of at least one of a tungsten carbide material, a polycrystalline diamond compact material, or a diamond material.

5. The displacement assembly as recited in claim 1, further comprising a guide to maintain an orientation of the displacement mechanism with respect to the housing as the displacement mechanism reciprocates in the housing.

6. The displacement assembly as recited in claim 1, further comprising a sleeve disposed between the displacement mechanism and the housing, wherein the sleeve comprises at least one of a tungsten carbide material, a polycrystalline diamond compact material, or a diamond material.

7. The displacement assembly of claim 1, wherein the displacement assembly is located uphole from a gage portion of a drill bit.

8. A displacement assembly comprising:

a housing defining a passage on an inner surface of the housing, the housing to be in fluid communication with a pressurized fluid supply proximate to a first end of the passage; and a piston slidably coupled with the housing to reciprocate in the passage from a first, fully retracted, orientation where the piston is proximate to the first end of the passage toward a second, fully extended, orientation where the piston is proximate to a second end of the passage opposite the first end, the piston having an outer surface and an inner surface opposite the outer surface, and the piston and the housing allowing the pressurized fluid to migrate through the passage from the first end of the passage to the second end of the passage when the piston is in the second, fully extended, orientation, the piston having a path from the second, fully extended, orientation to the first, fully retracted, orientation, an exhaust port from which the pressurized fluid exits the passage being located on the outer surface, the exhaust port being oriented transverse to the outer surface, a contact between the outer surface and the inner surface of the housing at the exhaust port defining a seal for preventing pressurized fluid from the pressurized fluid supply from migrating through the passage from the first end of the passage to the second end of the passage when the piston is in the first, fully retracted, position.

9. The displacement assembly as recited in claim 8, wherein the piston defines an exhaust path connecting the first end of the passage to the second end of the passage when the piston is in the second, fully extended, orientation.

10. The displacement assembly as recited in claim 9, wherein the piston defines a chamber at an end of the exhaust path.

11. The displacement assembly as recited in claim 8, further comprising a sealing surface disposed on the housing that prevents pressurized fluid from the pressurized fluid supply from migrating through the passage from the first end of the passage to the second end of the passage when the piston is in the first, fully retracted, orientation.

12. The displacement assembly as recited in claim 11, wherein the sealing surface comprises a pad of at least one of a tungsten carbide material, a polycrystalline diamond compact material, or a diamond material.

13. The displacement assembly as recited in claim 8, further comprising a guide to maintain an orientation of the piston with respect to the housing as the piston reciprocates in the housing.

14. The displacement assembly as recited in claim 8, further comprising a sleeve disposed between the piston and the housing.

15. The displacement assembly as recited in claim 14, wherein the sleeve comprises at least one of a tungsten carbide material, a polycrystalline diamond compact material, or a diamond material.

16. A displacement assembly comprising:

a housing defining a passage to be in fluid communication with a pressurized fluid supply proximate to a first end of the passage; a displacement mechanism slidably coupled with the housing to reciprocate in the passage from a first, fully retracted, orientation where the displacement mechanism is proximate to the first end of the passage toward a second, fully extended, orientation where the displacement mechanism is proximate to a second end of the passage opposite the first end, the displacement mechanism and the housing defining a seal for preventing pressurized fluid from the pressurized fluid supply from migrating through the passage from the first end of the passage to the second end of the passage when the displacement mechanism is in the first, fully retracted, orientation, the displacement mechanism defining an exhaust path connecting the first end of the passage to the second end of the passage through an exhaust port when the displacement mechanism is in the second, fully extended, orientation that allows the pressurized fluid to migrate through the passage from the first end of the passage to the second end of the passage when the displacement mechanism is in the second, fully extended, orientation, the displacement mechanism having a first path from the first, fully retracted, orientation to the second, fully extended, orientation and a second path from the second, fully extended, orientation to the first, fully retracted, orientation, the pressurized fluid exiting the exhaust port transverse to a displacement mechanism longitudinal axis of the displacement mechanism, the first path and the second path being linear, the displacement mechanism defining a chamber at an end of the exhaust path; and a valve to be in fluid communication with the pressurized fluid supply, the valve biased to move to a first position when the displacement mechanism is in the second, fully extended, orientation, and to move to a second position when the displacement mechanism is in the first, fully retracted, orientation.

17. The displacement assembly as recited in claim 16, further comprising a sealing surface disposed on the housing that prevents pressurized fluid from the pressurized fluid supply from migrating through the passage from the first end of the passage to the second end of the passage when the displacement mechanism is in the first, fully retracted, orientation.

18. The displacement assembly as recited in claim 17, wherein the sealing surface comprises a pad of at least one of a tungsten carbide material, a polycrystalline diamond compact material, or a diamond material.

19. The displacement assembly as recited in claim 16, further comprising a guide to maintain an orientation of the displacement mechanism with respect to the housing as the displacement mechanism reciprocates in the housing.

20. The displacement assembly as recited in claim 16, further comprising a sleeve disposed between the displacement mechanism and the housing.

* * * * *